US009404398B2

(12) United States Patent
Lee et al.

(10) Patent No.: US 9,404,398 B2
(45) Date of Patent: Aug. 2, 2016

(54) CONTINUOUSLY VARIABLE VALVE TIMING DEVICE

(71) Applicants: Hyundai Motor Company, Seoul (KR); Kia Motors Corporation, Seoul (KR)

(72) Inventors: Seung Woo Lee, Seoul (KR); Hyunjin Kang, Busan (KR); Jae-Chun Kim, Gyeonggi-Do (KR); Hong Kil Baek, Seoul (KR); Gang Il Kim, Gyeonggi-Do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 86 days.

(21) Appl. No.: 14/302,774

(22) Filed: Jun. 12, 2014

(65) Prior Publication Data

US 2015/0128888 A1 May 14, 2015

(30) Foreign Application Priority Data

Nov. 12, 2013 (KR) ..... 10-2013-0137066

(51) Int. Cl.
*F01L 1/34* (2006.01)
*F01L 1/344* (2006.01)

(52) U.S. Cl.
CPC ..... *F01L 1/344* (2013.01)

(58) Field of Classification Search
CPC .... F01L 1/352; F01L 1/344; F01L 2001/3522
USPC ..... 123/90.15–90.17
See application file for complete search history.

(56) References Cited

U.S. PATENT DOCUMENTS 8,973,545 B2 * 3/2015 Kawada ..... F01L 1/34 123/90.15
2012/0174883 A1 * 7/2012 Kokubo ..... F01L 1/352 123/90.15
2013/0206087 A1 * 8/2013 Tadokoro ..... F01L 1/352 123/90.15
2014/0165938 A1 * 6/2014 Kawada ..... F01L 1/34 123/90.15
2014/0216202 A1 * 8/2014 Tadokoro ..... F01L 1/344 74/568 R
2014/0216374 A1 * 8/2014 Tadokoro ..... F01L 1/344 123/90.15

FOREIGN PATENT DOCUMENTS

JP 2012-002210 A 1/2012
JP 2012-012961 A 1/2012
JP 2014118895 A * 12/2012 ..... F01L 1/34
KR 10 2009-012787 A 11/2009

* cited by examiner

*Primary Examiner* — Thomas Denion
*Assistant Examiner* — Daniel Bernstein
(74) *Attorney, Agent, or Firm* — Mintz Levin Cohn Ferris Glovsky and Popeo, P.C.; Peter F. Corless

(57) ABSTRACT

A continuously variable valve timing device is provided and includes a cam sprocket connected with a camshaft having a plurality of cams to rotate the camshaft and an electric variable valve timing mechanism connected with the cam sprocket, and driven by an electric motor. A chain cover protects the cam sprocket and a chain system from foreign substances and an electric variable valve timing mechanism cover protects the electric variable valve timing mechanism from foreign substances. A seal ring partitions an internal space between the electric variable valve timing mechanism and the electric variable valve timing mechanism cover. In addition, a pressure maintaining device is mounted within the electric variable valve timing mechanism cover to maintain pressure formed within the internal space of the electric variable valve timing mechanism cover at about atmospheric pressure.

4 Claims, 3 Drawing Sheets

CONTINUOUSLY VARIABLE VALVE TIMING DEVICE

CROSS-REFERENCE TO RELATED APPLICATION

The present application claims priority of Korean Patent Application Number 10-2013-0137066 filed on Nov. 12, 2013, the entire contents of which application are incorporated herein for all purposes by this reference.

BACKGROUND (a) Field of Invention

The present invention relates to a continuously variable valve timing device, and more particularly, to a continuously variable valve timing device that maintains internal pressure of an electric variable valve timing mechanism cover partitioned by a seal ring, at atmospheric pressure to preserve function and durability of the seal ring, and prevent malfunction of an electricity driven motor.

(b) Description of Related Art

In general, an internal combustion engine is an apparatus that generates power by suctioning air and fuel from the exterior of a vehicle, and combusting fuel in a combustion chamber, and has an intake valve configured to suction air and fuel into the combustion chamber, and an exhaust valve configured to discharge explosion gas combusted in the combustion chamber, and the intake and exhaust valves are opened and closed in conjunction with rotation of a camshaft.

Optimum opening and closing timing of the intake and exhaust valves may be varied based on an engine revolution per minute (RPM), an engine load, and the like. Therefore, a technology, which properly controls valve timing based on a driving state of the engine by having a displacement within a set range without definitely setting the rotation of the camshaft based on rotation of a crankshaft, has been developed, and this technology is referred to as a variable valve timing (VVT) device. In addition, the continuously variable valve timing (CVVT) device is a type of variable valve timing device, and has a configuration that may control valve timing with an arbitrary value within a predetermined displacement.

The continuously variable valve timing device includes a cam sprocket connected to the camshaft to rotate the camshaft, an electric variable valve timing mechanism connected with the cam sprocket and driven by a motor, a chain cover configured to protect the cam sprocket and a chain system from foreign substances, an electric variable valve timing mechanism cover configured to protect the electric variable valve timing mechanism from foreign substances, a seal ring mounted between the electric variable valve timing mechanism and the electric variable valve timing mechanism cover, and partitions an internal space of the electric variable valve timing mechanism cover to block oil from flowing toward a brush of a connector installed on a slip ring of the electric variable valve timing mechanism and the electric variable valve timing mechanism cover, and a rubber plug mounted in a mounting aperture formed within the electric variable valve timing mechanism cover to prevent an inflow of foreign substances such as moisture and dust.

However, in the aforementioned continuously variable valve timing device in the related art, pressure in the internal space of the electric variable valve timing mechanism cover may be varied due to a variation in temperature of the engine and due to an oil seal structure that seals a contact portion of a rotating body, a seal line of the seal ring may be damaged when pressure increases due to the variation in pressure, durability such as an increase in frictional force of the oil seal may occur pressure is reduced, oil may flow from the engine side through a gap in the damaged seal ring, and as a result, a malfunction may occur on the motor that drives the electric variable valve timing mechanism.

The above information disclosed in this section is merely for enhancement of understanding of the background of the invention and therefore it may contain information that does not form the prior art that is already known in this country to a person of ordinary skill in the art.

SUMMARY

The present invention provides a continuously variable valve timing device configured to maintain pressure in an internal space of an electric variable valve timing mechanism cover at atmospheric pressure using a pressure maintaining device, to preserve a function and durability of a seal ring, thereby continuously preventing oil from leaking to the internal space of the electric variable valve timing mechanism cover.

An exemplary embodiment of the present invention provides a continuously variable valve timing device that may include: a cam sprocket connected with a camshaft having a plurality of cams to rotate the camshaft; an electric variable valve timing mechanism connected with the cam sprocket, and driven by an electric motor; a chain cover configured to protect the cam sprocket and a chain system from foreign substances; an electric variable valve timing mechanism cover configured to protect the electric variable valve timing mechanism from foreign substances; and a seal ring that partitions an internal space between the electric variable valve timing mechanism and the electric variable valve timing mechanism cover.

The continuously variable valve timing device may include: a pressure maintaining device mounted within the electric variable valve timing mechanism cover to maintain pressure formed within the internal space of the electric variable valve timing mechanism cover at atmospheric pressure.

In addition, the pressure maintaining device may include: a plug mounted within a mounting aperture formed within the electric variable valve timing mechanism cover, and may have a circulation aperture formed at a substantial center of the plug to allow gas to flow in and out, and an installation space formed at an inner side of the plug; a film member may be mounted within the installation space of the plug to allow gas to pass therethrough; and a support member may be fitted into the installation space of the plug to support the film member, and may have an aperture formed at a substantial center thereof.

In addition, the plug may include: a circular body portion having a circulation aperture formed at a substantial center thereof; and an insertion portion extended inward along an outer circumferential surface of the body portion to be fitted into an inner circumferential surface of the mounting aperture within the electric variable valve timing mechanism cover, and may form the installation space. The insertion portion may have a fitting groove formed around an outer circumferential surface of the insertion portion to be fitted into the inner circumferential surface of the mounting aperture. Further, the film member may be made of a material such as polytetrafluoroethylene that allows gas to pass therethrough.

The exemplary embodiment of the present invention may be configured to maintain pressure within the internal space of the electric variable valve timing mechanism cover at atmospheric pressure using the pressure maintaining device to maintain a function of the seal ring and preserve durability of the seal ring, and prevent oil from flowing toward the contact portion of the brush of the connector, which may be installed on the slip ring of the electric variable valve timing mechanism and the electric variable valve timing mechanism cover, using the seal ring durability of which may be maintained, thereby improving operational reliability of the electric variable valve timing mechanism. In addition, pressure within the internal space of the electric variable valve timing mechanism cover may be maintained using the pressure maintaining device, and foreign substances such as moisture and dust may be blocked from flowing into the system, thereby preventing malfunction of the electric variable valve timing mechanism.

DETAILED DESCRIPTIONS

Figure 1:
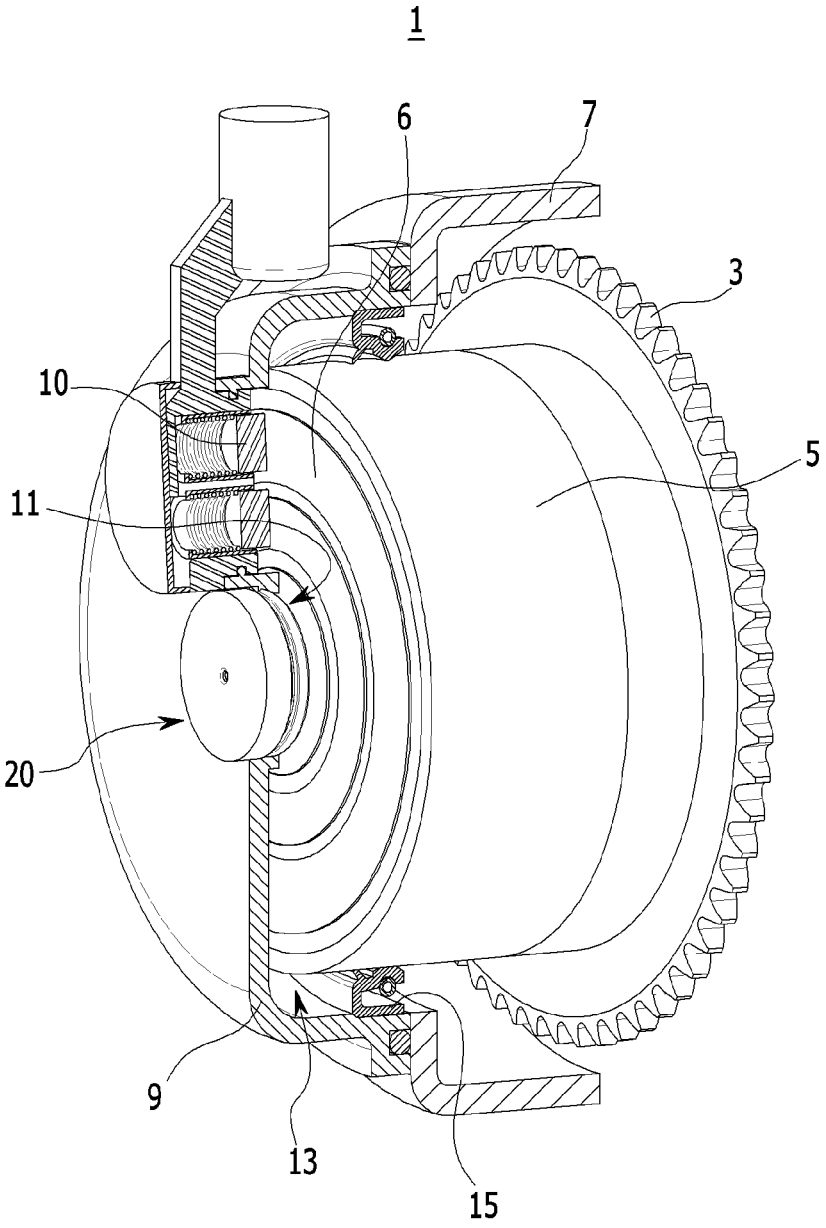
FIG. 1 is an exemplary partially cut-away view of a continuously variable valve timing device according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, an exemplary embodiment of the present invention will be described in detail with reference to the accompanying drawings. The size and thickness of each component illustrated in the drawings are arbitrarily shown for understanding and ease of description, but the present invention is not limited thereto. Thicknesses of several portions and regions are exaggerated for clarity. In addition, a part irrelevant to the description will be omitted to clearly describe the exemplary embodiment of the present invention.

FIG. 1 is an exemplary partially cut-away perspective view of a continuously variable valve timing device according to an exemplary embodiment of the present invention. Referring to FIG. 1, a continuously variable valve timing device 1 according to an exemplary embodiment of the present invention may include a cam sprocket 3, an electric variable valve timing mechanism 5, a chain cover 7, an electric variable valve timing mechanism cover 9, and a seal ring 15.

The cam sprocket 3 may be connected to a camshaft (not illustrated), which may have a plurality of cams (not illustrated), to rotate the camshaft, and the electric variable valve timing mechanism 5 may be connected with the cam sprocket 3. The chain cover 7 may be configured to protect the cam sprocket 3 from foreign substances such as moisture and dust. The electric variable valve timing mechanism cover 9 may be configured to protect the electric variable valve timing mechanism 5 from foreign substances such as moisture and dust. The seal ring 15 may be mounted between an outer circumferential surface of the electric variable valve timing mechanism 5 and an inner circumferential surface of the electric variable valve timing mechanism cover 9 to prevent oil from flowing toward a contact portion of a brush 10 of a connector installed on a slip ring 6 of the electric variable valve timing mechanism 5 and the electric variable valve timing mechanism cover 9, and may partition an internal space 13 between an inner surface of the electric variable valve timing mechanism cover 9 and the electric variable valve timing mechanism 5.

The continuously variable valve timing device 1 may be configured to maintain pressure formed within the internal space 13 of the electric variable valve timing mechanism cover 9 at about atmospheric pressure to maintain a function of the seal ring 15 and preserve durability of the seal ring 15, and may be configured to prevent oil from flowing toward the contact portion of the brush 10 of the connector installed on the slip ring 6 of the electric variable valve timing mechanism 5 and the electric variable valve timing mechanism cover 9, using the seal ring 15, thereby improving operational reliability of the electric variable valve timing mechanism 5 that is driven by electricity.

Figure 2:
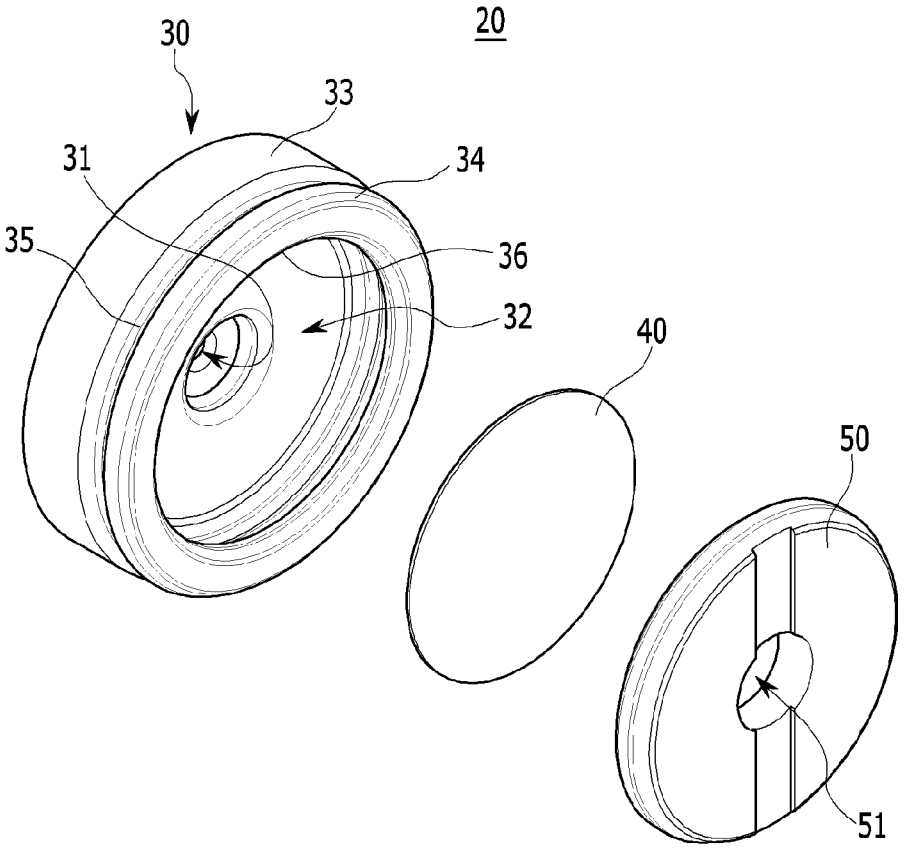
FIG. 2 is an exemplary detailed view of a pressure maintaining device applied to the continuously variable valve timing device according to the exemplary embodiment of the present invention.
Figure 3:
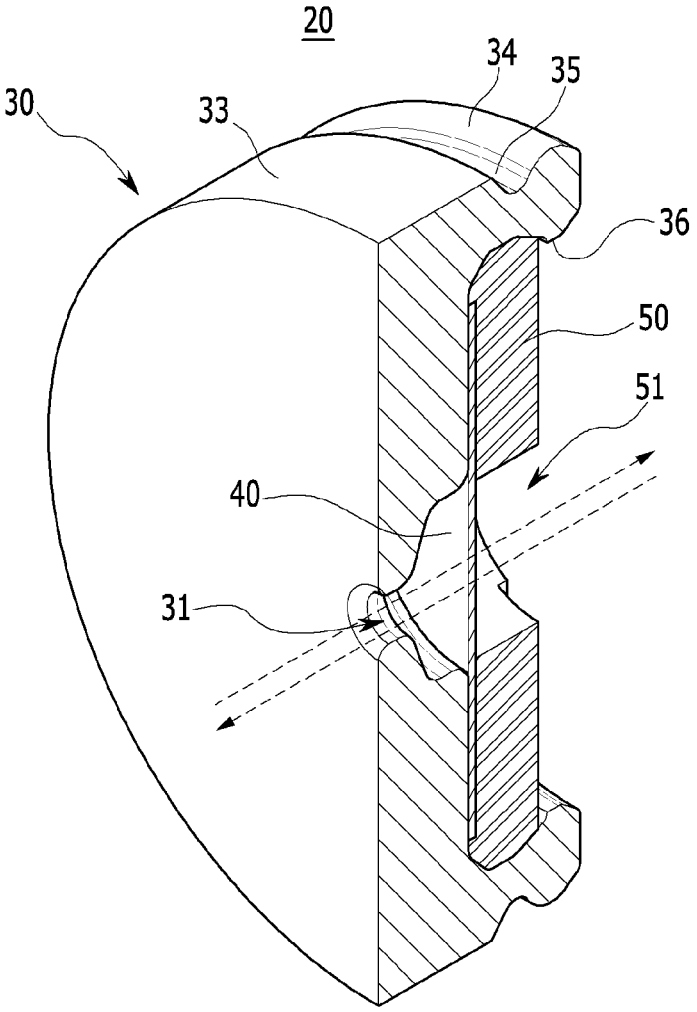
FIG. 3 is an exemplary partially cut-away view of the pressure maintaining device applied to the continuously variable valve timing device according to the exemplary embodiment of the present invention.

FIG. 2 is an exemplary detailed view of a pressure maintaining device applied to the continuously variable valve timing device according to the exemplary embodiment of the present invention, and FIG. 3 is an exemplary partially cut-away perspective view of the pressure maintaining device applied to the continuously variable valve timing device according to the exemplary embodiment of the present invention.

Referring to FIGS. 2 and 3, the continuously variable valve timing device 1 according to the exemplary embodiment of the present invention may further include a pressure maintaining device 20. The pressure maintaining device 20 may be mounted within the electric variable valve timing mechanism cover 9 to maintain pressure formed within the internal space 13 of the electric variable valve timing mechanism cover 9 at about atmospheric pressure. The pressure maintaining device 20 may include a plug 30, a film member 40, and a support member 50.

The plug 30 may be mounted within a mounting aperture 11 formed within the electric variable valve timing mechanism cover 9, and may include a circulation aperture 31 formed at about a center of the plug 30 to allow gas such as air to flow in and out of the system, and an installation space 32 formed at an inner side of the plug 30, and the plug 30 may be made of rubber. In particular, the plug 30 may include a body portion 33 and an insertion portion 34. The circulation aperture 31 may be formed at about a center of the body portion 33, and the body portion 33 may have a substantially circular shape.

The insertion portion 34 may be extended inward along an outer circumferential surface of the body portion 33 to be fitted into an inner circumferential surface of the mounting aperture 11 of the electric variable valve timing mechanism cover 9, and may form the installation space 32. The insertion portion 34 may include a fitting groove 35 formed around an outer circumferential surface of the insertion portion 34, to be fitted into the inner circumferential surface of the mounting aperture 11. In addition, to prevent the support member 50 from being pulled out, the insertion portion 34 may include a catching projection 36 formed at a tip (e.g., an end) of the installation space 32. The plug 30, which is described above, may be mounted within the mounting aperture 11 formed in the electric variable valve timing mechanism cover 9 to block foreign substances such as moisture and dust from flowing into the electric variable valve timing mechanism cover 9, thereby preventing the motor, which drives the electric variable valve timing mechanism 5, from malfunctioning.

In the exemplary embodiment of the present invention, the film member 40 may be mounted within the installation space 32 of the plug 30 to allow gas such as air to pass through the film member 40. In other words, the film member 40 may be configured to maintain pressure formed within the internal space 13 of the electric variable valve timing mechanism cover 9 at about atmospheric pressure to preserve durability of the seal ring 15, and prevent oil in the engine from flowing to the outer circumferential surface of the electric variable valve timing mechanism 5 using the seal ring 15, thereby improving operational reliability of the electric variable valve timing mechanism 5.

The film member 40 may be made of a material such as polytetrafluoroethylene that allows gas to pass therethrough. In particular, the polytetrafluoroethylene (PTFE) is non-flammable fluororesin which belongs to organic polymer materials that are formed by large molecules made by chemically combining a plurality of small molecules (monomers) in chain conformation or in a network structure, and the polytetrafluoroethylene is resistant to heat, and has an extremely low friction coefficient, and excellent chemical resistance. In addition, the polytetrafluoroethylene is resistant against many chemicals, has a smooth surface, and maintains physical properties within a wide temperature range (e.g., about −270 to 250° C.). Owing to the aforementioned properties, the polytetrafluoroethylene may be used as a protective film for gaskets, bearings, inner walls of containers and pipes, components of valves and pumps used in a corrosive environment, cooking utensils, saw blades, and other products. Since the aforementioned polytetrafluoroethylene is a publicly known technology that is widely known to those skilled in the art, a more detailed description thereof will be omitted below.

The support member 50 may be fitted into the installation space 32 of the plug 30 to support the film member 40, and an aperture 51 may be formed at a substantially center portion of the support member 50. Particularly, the aperture 51 may have a larger diameter than the circulation aperture 31. In other words, as illustrated in FIG. 3, in the continuously variable valve timing device 1 according to the exemplary embodiment of the present invention, the pressure maintaining device 20 may be mounted within the mounting aperture 11 of the electric variable valve timing mechanism cover 9 to repeatedly circulate air outside the electric variable valve timing mechanism cover 9 and air inside the electric variable valve timing mechanism cover 9 through the circulation aperture 31 of the plug 30, the film member 40, and the aperture 51 of the support member 50, and maintain pressure formed in the internal space 13 of the electric variable valve timing mechanism cover 9 at about atmospheric pressure, such that a sealing function and durability of the seal ring 15 may be preserved, and oil in the engine may be prevented from flowing toward the contact portion of the brush 10 of the connector installed on the slip ring 6 of the electric variable valve timing mechanism 5 and the electric variable valve timing mechanism cover 9, using the seal ring 15, thereby improving operational reliability of the motor that drives the electric variable valve timing mechanism 5.

Therefore, the continuously variable valve timing device 1 according to the exemplary embodiment of the present invention may be configured to maintain pressure within the internal space 13 of the electric variable valve timing mechanism cover 9 at about atmospheric pressure using the pressure maintaining device 20 to preserve a function and durability of the seal ring 15, and prevent oil in the engine from flowing toward the contact portion of the brush 10 of the connector installed on the slip ring 6 of the electric variable valve timing mechanism 5 and the electric variable valve timing mechanism cover 9, using the seal ring 15, thereby improving operational reliability of the motor that drives the electric variable valve timing mechanism 5. In addition, pressure within the internal space 13 of the electric variable valve timing mechanism cover 9 may be maintained using the pressure maintaining device 20, and foreign substances such as moisture and dust may be blocked from flowing in, thereby preventing malfunction of the electric variable valve timing mechanism 5.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

DESCRIPTION OF SYMBOLS

1 . . . Continuously variable valve timing device
3 . . . Cam sprocket
5 . . . Electric variable valve timing mechanism
6 . . . Slip ring
7 . . . Chain cover
9 . . . Electric variable valve timing mechanism cover
10 . . . Brush
11 . . . Mounting aperture
13 . . . Internal space
15 . . . Seal ring
20 . . . Pressure maintaining device
30 . . . Plug
31 . . . Circulation aperture
32 . . . Installation space
33 . . . Body portion
34 . . . Insertion portion
35 . . . Fitting groove
36 . . . Catching projection
40 . . . Film member
50 . . . Support member
51 . . . Aperture

What is claimed is:

1. A continuously variable valve timing device, comprising:

a cam sprocket connected with a camshaft having a plurality of cams to rotate the camshaft;

an electric variable valve timing mechanism connected with the cam sprocket, and driven by an electric motor;

a chain cover configured to protect the cam sprocket and a chain system from foreign substances;

an electric variable valve timing mechanism cover configured to protect the electric variable valve timing mechanism from foreign substances;

a seal ring configured to partition an internal space between the electric variable valve timing mechanism and the electric variable valve timing mechanism cover; and a pressure maintaining device mounted within the electric variable valve timing mechanism cover to maintain pressure formed within the internal space of the electric variable valve timing mechanism cover at about atmospheric pressure, wherein the pressure maintaining device includes:

a plug mounted within a mounting aperture formed within the electric variable valve timing mechanism cover, and has a circulation aperture formed at a center of the plug to allow gas to flow in and out, and an installation space formed at an inner side of the plug;

a film member mounted within the installation space of the plug to allow gas to pass therethrough; and a support member fitted into the installation space of the plug support the film member, and having an aperture formed at a center thereof.

2. The continuously variable valve timing device of claim 1, wherein the plug includes:

a circular body portion having a circulation aperture formed at a center thereof; and an insertion portion extended inward along an outer circumferential surface of the body portion to be fitted into an inner circumferential surface of the mounting aperture in the electric variable valve timing mechanism cover, and forms the installation space.

3. The continuously variable valve timing device of claim 2, wherein the insertion portion has a fitting groove formed around an outer circumferential surface of the insertion portion to be fitted into the inner circumferential surface of the mounting aperture.

4. The continuously variable valve timing device of claim 1, wherein the film member is made of a material such as polytetrafluoroethylene (PTFE) that allows gas to pass therethrough.

* * * * *